US007546718B2

(12) United States Patent
Vasta

(10) Patent No.: US 7,546,718 B2
(45) Date of Patent: Jun. 16, 2009

(54) EXTENSIBLE BEAM

(76) Inventor: Salvatore Vasta, 20 Cattle St., Edmonton, Queensland 4869 (AU)

( * ) Notice: Subject to any disclaimer, the term of this patent is extended or adjusted under 35 U.S.C. 154(b) by 303 days.

(21) Appl. No.: 10/560,950

(22) PCT Filed: Jun. 18, 2004

(86) PCT No.: PCT/AU2004/000805

§ 371 (c)(1),
(2), (4) Date: Dec. 15, 2005

(87) PCT Pub. No.: WO2004/111361

PCT Pub. Date: Dec. 23, 2004

(65) Prior Publication Data

US 2007/0089374 A1 Apr. 26, 2007

(30) Foreign Application Priority Data

Jun. 18, 2003 (AU) ..... 2003903086

(51) Int. Cl.
*E04H 12/18* (2006.01)

(52) U.S. Cl. ..... 52/632; 52/645; 52/126.1; 52/210; 52/118; 52/481.1; 52/217

(58) Field of Classification Search ..... 52/632, 52/204.2, 111, 127.2, 645, 204.1, 238.1, 52/481.1, 243.1, 741.1, 241–243, 290, 630, 52/664, 573, 690, 634, 588.1, 655.1, 126.6, 52/656.1, 217, 210, 118, FOR. 130, FOR. 134, 52/FOR. 135, 800.11, 800.12, 800.16, 801.11, 52/801.1, 802.1; 248/351, 354.1, 354.4, 248/354.5; 182/223

See application file for complete search history.

(56) References Cited

U.S. PATENT DOCUMENTS 2,218,426 A * 10/1940 Hurlbert, Jr.
2,276,139 A * 3/1942 Anderson et al. ..... 454/331
2,351,570 A * 6/1944 Williams et al. ..... 160/228
2,447,865 A * 8/1948 McClintock ..... 182/223
2,796,158 A * 6/1957 Miles et al. ..... 52/241
2,874,006 A * 2/1959 Sloyan ..... 384/29
3,008,550 A * 11/1961 Miles et al. ..... 52/210
3,039,731 A * 6/1962 Young ..... 52/632
3,222,095 A * 12/1965 Gerus ..... 403/104
3,325,957 A * 6/1967 Demeules et al. ..... 52/632
3,492,766 A * 2/1970 Andrews ..... 52/36.6
3,830,468 A * 8/1974 Whitchurch et al. ..... 254/98
3,846,950 A * 11/1974 Hansen ..... 52/632
3,854,264 A * 12/1974 Thomassen (Continued)

FOREIGN PATENT DOCUMENTS

AU 161186 2/1955

(Continued)

*Primary Examiner*—Jeanette Chapman
(74) *Attorney, Agent, or Firm*—Simpson & Simpson, PLLC

(57) ABSTRACT

An extensible beam (1) comprising: a first, elongate element (10), a second element (50) adapted to move relative to the first elongate element in order to vary the amount of overlap between the first and second elements and thereby vary the length of the beam. Wherein the first element includes first (18) and second (20) support portions and the second element includes first (52) and second (54) spaced apart strut members for engagement with the first and second support portions respectively.

20 Claims, 7 Drawing Sheets

U.S. PATENT DOCUMENTS

| | | | | | |
|---|---|---|---|---|---|
| 3,868,474 | A * | 2/1975 | Bunten | 174/38 |
| 3,897,668 | A * | 8/1975 | McDonnell | |
| 4,018,020 | A * | 4/1977 | Sauer et al. | 52/241 |
| 4,038,710 | A * | 8/1977 | Tambascio | 5/200.1 |
| 4,062,156 | A * | 12/1977 | Roth | 52/111 |
| 4,397,127 | A * | 8/1983 | Mieyal | 52/241 |
| 4,449,876 | A * | 5/1984 | Glanton | 410/151 |
| 4,768,620 | A * | 9/1988 | South | 182/223 |
| 4,825,610 | A * | 5/1989 | Gasteiger | 52/217 |
| 5,040,345 | A * | 8/1991 | Gilmour | |
| 5,127,760 | A * | 7/1992 | Brady | |
| 5,321,924 | A * | 6/1994 | Smolik | 52/204.1 |
| 5,325,651 | A * | 7/1994 | Meyer et al. | |
| 5,343,667 | A * | 9/1994 | Peden | 52/699 |
| 5,397,127 | A * | 3/1995 | Kawada et al. | |
| 5,444,948 | A * | 8/1995 | Trapp | 52/127.2 |
| 5,634,301 | A * | 6/1997 | Koller | 52/127.2 |
| 5,685,121 | A * | 11/1997 | DeFrancesco et al. | 52/731.9 |
| 5,927,038 | A * | 7/1999 | Goldberg et al. | 52/632 |
| 6,050,045 | A * | 4/2000 | Campbell | |
| 6,176,053 | B1 * | 1/2001 | St. Germain | 52/232 |
| 6,494,005 | B2 * | 12/2002 | Zimmerman | 52/296 |
| 6,506,973 | B1 * | 1/2003 | Howard et al. | 174/493 |
| 6,530,186 | B2 * | 3/2003 | Torstensen | 52/217 |
| 6,871,470 | B1 * | 3/2005 | Stover | 52/648.1 |
| 6,879,490 | B2 * | 4/2005 | Mattei et al. | 361/727 |
| 6,938,387 | B2 * | 9/2005 | Belanger | 52/645 |
| 7,216,465 | B2 * | 5/2007 | Saldana | |
| 2002/0116891 | A1 * | 8/2002 | Waldrop | 52/632 |
| 2007/0089374 | A1 * | 4/2007 | Vasta | 52/204.2 |

FOREIGN PATENT DOCUMENTS

| | | | |
|---|---|---|---|
| AU | 162969 | | 5/1955 |
| AU | 221688 | | 12/1957 |
| AU | 34916/84 | | 11/1988 |
| AU | B 29689/89 | | 8/1989 |
| AU | 199886112 | B2 | 6/1999 |
| AU | 199943524 | B2 | 6/2000 |
| AU | 200018463 | B2 | 8/2000 |
| AU | 200050529 | A1 | 3/2001 |
| AU | 35141 | | 4/2001 |
| EP | 0434559 | A1 | 6/1991 |
| EP | 0435480 | A1 | 7/1991 |
| GB | 1012150 | | 12/1965 |
| GB | 2150610 | A | 7/1985 |
| GB | 2287969 | A | 10/1985 |
| GB | 2217763 | A | 11/1989 |
| WO | WO 83/04294 | | 12/1983 |
| WO | WO 00/71827 | A1 * | 11/2000 |

* cited by examiner

EXTENSIBLE BEAM

CROSS-REFERENCE TO RELATED APPLICATIONS

This application is the National Stage of PCT International Patent Application No. PCT/AU2004/000805 filed on Jun. 18, 2004, which application was published in English; said international application claims foreign priority of Australian Patent Application No. 2003903086 filed on Jun. 18, 2003.

FIELD OF THE INVENTION

The present invention relates to an extensible beam, and especially, but not exclusively, to such a beam in the form of a lintel.

BACKGROUND

Lintels are used for supporting structural loads above openings, such as windows, in walls.

If the structure above the lintel is sufficiently strong when construction is completed, the lintel may be removed for re-use.

One such removable lintel comprises axial steel inner and outer elongate members, both of generally square C-shaped cross-section, which can slide axially relative to each other in order to vary the length of the lintel in a telescopic fashion. The two members are of approximately equal length and each member has a flat, horizontal projection at a distal end, by which the lintel can be supported across an opening, upon respective opposing lips or edges of the structure defining the sides of the opening. In use, the lintel is extended so that the projections are supported on the tops of the opposed wall parts which define opposite sides of the opening and so that the elongate members provide a generally horizontal upper surface for supporting construction to be formed above the opening. The remainder of the wall is then constructed, including construction materials such as bricks and/or mortar which may be placed upon the upper surface of the lintel, including the upper surfaces of the projections. When the construction above the opening is secure, and self-supporting, the lintel is contracted by sliding the inner elongate member into the outer elongate member, which involves removal of one projection from its load-supporting position, and then removal of the other projection from its load-supporting position so that the lintel as a whole can be removed from the opening.

However, the inventor of the present invention has recognised that certain problems exist with the above described lintel. Problems include that the construction consisting of two similarly sized C-section elongate members is heavy, making the lintel awkward to handle. Furthermore, because the inner and outer members are similar in cross-section and rely upon this similarity to align the members in use, the contact area between the members is high, resulting in significant friction in operation, especially if building materials are inadvertently introduced between the members. Also, there may be a difference in angle or height of the upper surfaces presented by the two members for supporting the new construction and this may lead to inaccuracy in the new construction, and especially in block work. There is therefore a need for an improved or at least alternative lintel.

SUMMARY OF THE INVENTION

According to a first aspect of the present invention, there is provided an extensible beam comprising:

a first, elongate, element;

a second element adapted to move relative to the first elongate element in order to vary the amount of overlap between the first and second elements and thereby vary the length of the beam;

wherein the first element includes first and second support portions; and the second element includes first and second spaced apart strut members for engagement with the first and second support portions respectively.

Preferably, the first element has an upper portion which, in use, provides a surface to support materials above the beam, and first and second lateral portions depending from the upper portion.

Preferably the first element comprises an elongate member with a radial cross section which defines a generally rectangular channel.

Preferably, the first element comprises a length of metal C-section.

Preferably, the first and second strut members comprise respective bars which have substantially greater thickness than the lateral portions of the first element.

Preferably, the bars are solid bars.

In a preferred embodiment, in use, with the beam extending substantially horizontally, the first and second strut members may be regarded as having a length in the axial direction of the beam, a vertical height, and a thickness in the lateral direction of the beam.

Preferably, the first and second strut members are dimensioned so that each is substantially uniform in cross-sectional shape through a substantial part of its length.

Preferably, the height of each strut member is greater than its thickness. This allows effective load bearing.

Preferably, the first and second strut members are generally rectangular in cross section.

The generally uniform cross sectional shape of the strut members may include one or more sides which are, to some extent, convex or concave.

Preferably, the height of each strut member is smaller than the height of the lateral portions of the first element.

Preferably, the height of each strut member is less than 80% of the height of the lateral portions of the first element.

Preferably, the height of each strut member is approximately two thirds of the height of the lateral portions of the first element.

Preferably, the second element comprises the first and second strut members and at least one cross member extending between the first and second strut members.

Preferably, the second element comprises first and second cross-members, each extending between the first and second strut members.

Preferably a first cross member extends between respective first ends of the first and second strut members and a second cross member extends between respective second ends of the first and second strut members.

The second element is preferably frame-like in form.

Preferably, the first and second support portions are adapted to slidingly engage the respective first and second strut members.

Preferably, the second element is located at least partially inside the first element.

Preferably, the second element is adapted, in use, to be moved further into the first element in order to reduce the length of the beam, and to be moved further out of the first element in order to increase the length of the beam.

The second element may be in the form of a frame having an open space between the first and second strut members.

The second element may be in the form of a frame which includes a web portion extending between the first and second strut members.

Preferably, the frame is generally rectangular.

The web portion is preferably adapted to prevent parts of a user from being caught within the frame, especially when the second element is being retracted into the first element.

The web portion preferably extends axially less than the entire length of the second element, and preferably less than half of the length of the second element.

Preferably, in the extended configuration less than half of the second element can extend out of the first element.

The web portion is preferably substantially planar.

The web portion preferably has a thickness substantially less than the thickness of the strut members.

The web portion may comprise a sheet of material, preferably sheet metal or metal mesh.

The web portion may mainly extend axially along a part of the second element which, in use, does not axially overlap with the first element when the beam is in an extended configuration. Preferably, the web portion does not extend along most of the length of the second element which, in use, does axially overlap with the first element when the beam is in an extended configuration.

Preferably, the first and second support portions are coupled to, and supported by, the respective first and second lateral portions.

Preferably, the axial length of each of the first and second strut members which engages a support portion in use at any given time is substantially less than the axial length of the first element.

Preferably, the axial length of each of the first and second strut members which engages a support portion in use at any given time is substantially less than the axial length of the second element.

Preferably, the first and second support portions each have a length, in the axial direction of the beam, which is substantially less than the axial length of the first element.

This allows the first and second elements to be fitted together so that the struts extend axially past the support portions in both axial directions, with one cross member to each axial side of the support portions. Providing support portions which are relatively short in axial length also helps reduce the contact area between the first and second elements.

Preferably, in use, the relative positions of the first and second elements are constrained so that substantially the entire length of each support portion is in contact with, or closely adjacent to, a part of the corresponding strut member, irrespective of whether the second element is retracted or extended relative to the first element.

Preferably, a first abutment portion of the second element is adapted to engage part of the first element to restrict axial movement of the second element out of the first element.

Preferably, the first abutment portion of the second element is provided by a part of a cross member.

Preferably, the first abutment portion of the second element is adapted to engage part of a support portion, and most preferably an end part of a support portion.

Preferably, the second element provides two first abutment portions to restrict axial movement of the second element out of the first element.

Preferably, a second abutment portion of the second element is adapted to engage part of the first element to restrict axial movement of the second element into the first element.

Preferably, the second abutment portion of the second element is provided by a part of a cross member.

Preferably, the second abutment portion of the second element is adapted to engage part of a support portion, and most preferably an end part of a support portion.

Preferably, the second element provides two second abutment portions to restrict axial movement of the second element into the first element.

Preferably, there is provided on the first element a first engaging portion for engaging a structure and providing support for the beam relative to the structure.

Preferably, the first engaging portion is adapted to engage a structure defining a first side of an opening to be spanned by said beam. The first engaging portion may be formed as an integral part of the first element, but is preferably a member coupled thereto.

Preferably, there is provided on the second element a second engaging portion for engaging a structure and providing support for the beam relative to the structure.

Preferably, the second engaging portion is adapted to engage a structure defining a second side of an opening to be spanned by said beam. The second engaging portion is preferably formed as an integral part of the second element but may be an additional member coupled thereto. The second engaging portion is preferably part of a cross member of the second element.

Preferably, the second engaging portion comprises a horizontally orientated substantially axially projecting portion.

Preferably, the second element comprises a substantially vertically orientated portion adjacent the second engagement portion.

Preferably there is provided a spacing portion for spacing the substantially vertically orientated portion from the structure defining the opening when the engaging portion engages the structure.

Preferably, in a contracted configuration of the beam the second element is adapted to be within the first element so that the second engaging portion does not protrude from the first element.

Preferably, in use, the strut members are substantially parallel to the lateral portions.

Preferably, in use, the strut members are spaced apart from the lateral portions.

Preferably, members which form the support portions include one or more parts which space apart the strut members from the lateral portions.

Preferably, the second element is dimensioned so that a degree of lateral movement within the first element is possible.

Preferably, approximately 2 mm of lateral movement is possible. This helps prevent binding or undue friction between the first and second elements.

Preferably, at least one element is made substantially from steel.

Preferably, the first and second elements are made substantially from steel.

Alternatively one, or both of, the first and second elements may be made substantially from aluminium, or from some other material.

According to a second aspect of the present invention there is provided an extensible beam comprising:

(a) a first elongate element comprising:

a top panel, for supporting building materials thereon; opposing side panels which in use project generally perpendicular from opposing sides of the top panel so that the top panel and side panels form three sides of the first element which is generally rectangular in radial cross section; and first and second support portions projecting inwardly from respective inner surfaces of the respective first and second side panels; and (b) a second element adapted to move relative to the first elongate element in order to vary the amount of overlap between the first and second elements and thereby vary the length of the beam, the second element comprising first and second generally parallel spaced apart strut members connected by at least one cross member;

whereby the first and second strut members are supported by the respective first and second support portions and able to slide relative thereto in order to provide relative axial movement of the second element relative to the first element.

It will be appreciated that one or more features set out above in relation to the first aspect may be incorporated into an extensible beam in accordance with the second aspect.

The generally rectangular cross section of the first element may provide one open side, and/or cut-outs in one or more of the panels.

The generally rectangular cross sectional shape may be provided by using a length of commercially available C-section.

BRIEF DESCRIPTION OF THE DRAWINGS

Embodiments of the present invention will be described, by way of example only, with reference to the accompanying drawings in which.

DETAILED DESCRIPTION OF THE DRAWINGS

Figure 1:
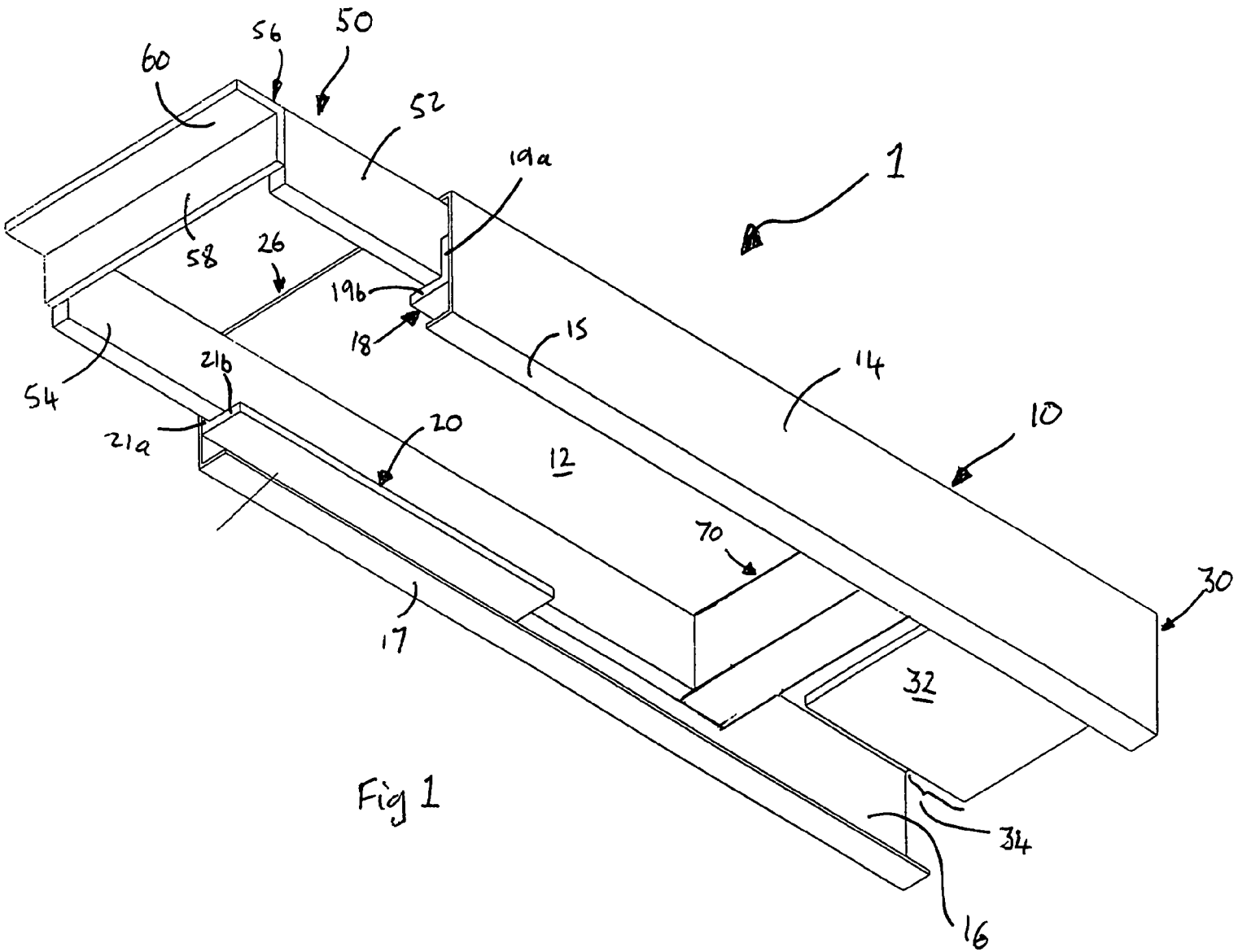
FIG. 1 is a perspective view from below of an embodiment of an extensible beam in accordance with the present invention.

With reference to FIG. 1, an embodiment of an extensible beam in accordance with the present invention in the form of a lintel, generally designated 1, includes a first, elongate, element in the form of an elongate main member 10 which is formed from sheet steel and is part-rectangular in radial cross-section to provide a generally C-shaped radial cross-section.

The lintel 1 further includes a second element in the form of a generally rectangular frame-like extension member 50. The extension member 50 may be manually slid into and out of the main member 10 in order to reduce or extend the length of the lintel 1.

The main member 10 comprises an elongate rectangular flat top panel 12, upon which, in use, materials forming construction above an opening are supported. The main member 10 further includes opposed first and second side panels 14, 16 which project at right angles from the two, opposite, longest edges of the top panel 12. The side panels 14, 16 are rectangular and of the same length as the top panel 12, and project away from the top panel 12 a distance slightly less than half the width of the top panel 12.

The first and second side panels 14, 16 have respective first and second turned-in portions 15, 17 which extend along the long sides of the side panels 14, 16 which are distal from the top panel 12, and project inwardly at right-angles to the side panels 14, 16. The top panel 12, side panels 14, 16 and turned-in portions 15, 17 are preferably formed integrally by folding or other forming of sheet steel. C-section steel of this type is a staple commercial product.

The main member 10 further comprises first and second support portions in the form of first and second track members 18, 20 which are, in this embodiment, formed by lengths of right-angle section steel which extend in the axial direction of the main member 10. The track members 18, 20 are welded to the inner surfaces of the respective side panels 14, 16 so that respective first limbs 19*a*, 21*a* of the respective lengths of angle section steel abut and extend parallel to the respective first and second side panels 14, 16, and so that respective second limbs 19*b*, 21*b* of the respective lengths of the right-angle section steel extend perpendicularly inwardly from the respective first and second side panels 14, 16. The second limbs 19*b*, 21*b* extend from the respective edges of the first limbs 19*a*, 21*a* which are closer to the turned in portions 15, 17 (and further from the top panel 12), and have upper faces (not shown) which face the top panel 12, and upon which the extension member 50 may be supported.

For ease of reference the front and rear of the beam, or of parts thereof, may be referred to herein and in the following description by terminology which implies a certain orientation of the beam (or lintel) will be used. The meaning of front and rear will be evident from the following description. For the purposes of terminology which implies a certain orientation of the beam or lintel, it is assumed that the lintel is oriented as is most likely in use, that is with the top panel 12 being substantially horizontal, and the side panels 14, 16 depending downwardly therefrom. Such terminology is used for convenience and the skilled person will appreciate that other orientations are possible.

As shown in FIG. 1, the main member 10 has a first (front) end 26 from which, in use, the extension member 50 can extend, and a second (rear) end 30, distal from the extension member. At the second end 30, there is provided a projecting member which in this embodiment is provided by a plate 32, fixed to the underside of the top panel 12 by a suitable means such as welding. The plate 32 extends rearwards beyond the second end of the top panel 12 to provide a projecting portion 34 which, in use, can support the second end of the main element 10 upon a structure which forms the side of an opening in a wall.

The extension element 50 includes first and second strut members in the form of first and second parallel elongate bars 52, 54. It will be appreciated that use of the word "strut" herein is not intended to imply the resistance to force in any specific direction. The first and second bars 52, 54 are spaced apart and are adapted to be supported by, and to slide upon, the first and second track members 18, 20.

The first and second bars 52, 54 are mutually connected and spaced apart by a cross member or connection member which in this embodiment is in the form of a lateral front piece 56 which is provided by a length of angle steel. The lateral front piece 56 has a vertically orientated first limb 58 which abuts, extends between and is coupled (by a suitable means such as welding) to the front ends of the elongate bars 52, 54. The lateral front piece 56 also has a horizontally orientated second limb 60 which projects forward, away from the first limb 58 from the upper long edge thereof, to provide a projecting portion which, in use, can support the extension member 50 of the lintel 1 upon a structure which defines the side of an opening in a wall.

The first and second bars are also connected, at their rearmost ends, by a cross member or connection member which in this embodiment is in the form of a lateral rear piece 70, which is formed from a piece of angle steel. A first limb 72 of the lateral rear piece 70 is vertically orientated and abuts, extends between and is coupled to the rear ends of the elongate bars 52, 54, and a second limb 74 is horizontally orientated and projects rearwardly away from the first limb 72.

It will be appreciated that dimensions, construction and materials may be varied according to the desired size and load bearing capabilities. However, by way of example, in a preferred lintel of the type shown in FIG. 1, details may be as follows:

the sheet steel of the main member 10 is 2.4 mm thick galvanised steel;

the top panel 12 is approximately 400 mm by 150 mm, the side panels are approximately 400 mm by 60 mm and the turned-in portions are approximately 400 mm by 20 mm;

the first and second bars 52, 54 are each mild steel approximately 300 mm long by 10 mm thick, by 40 mm high;

the first and second track members 18, 20 are 200 mm long and made from steel 5 mm thick with each limb extending approximately 20 mm from the other limb, so that the outside dimension of the section is about 25 mm, and the track members 18, 20 are welded to the side panels 14, 16 along substantially their entire length for strength;

the lateral front piece 56 is made from 30 mm by 30 mm angle steel of about 5 mm thickness; and the plate 32 is steel measuring 140 mm wide by 100 mm long by 6 mm thick and providing a projecting portion which extends about 30 mm beyond the top panel.

The dimensions given are by way of example only, and a specific level of accuracy of the exemplified dimensions should not be inferred from the fact that they are, for consistency, all given in millimeters.

As stated above, other materials could be used. Aluminium would be a suitable material, although the dimensions of various elements might have to be changed in order to accommodate strength requirements. For example, in one particular aluminium embodiment the sheet metal of the C-section forming the main member is 5 mm thick.

Figure 2:
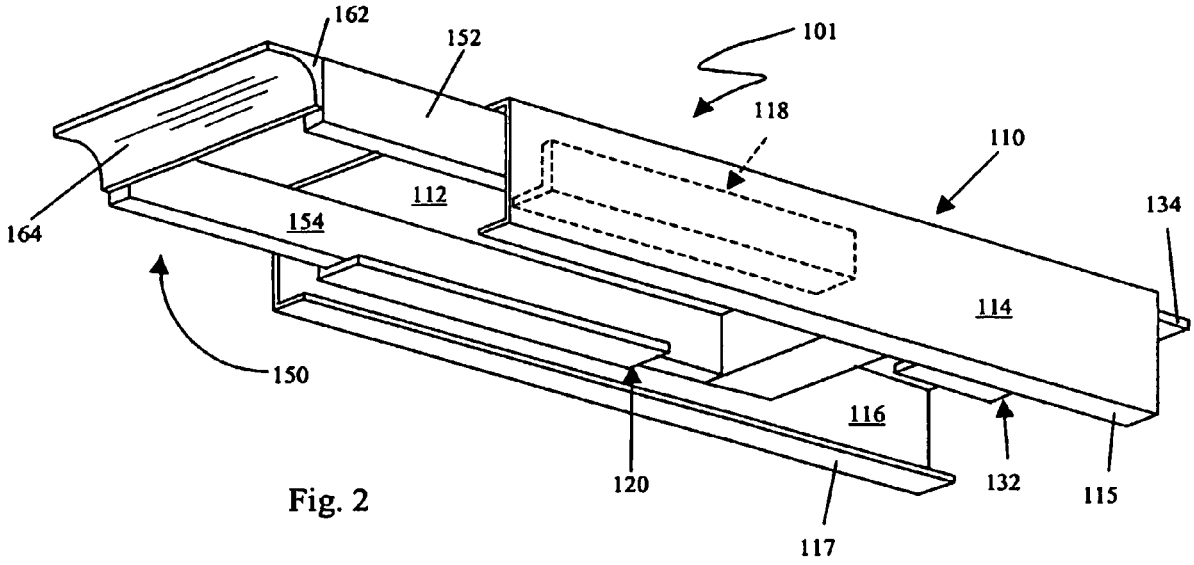
FIG. 2 is a perspective view from below of an alternative embodiment.

An alternative embodiment is shown in FIG. 2. This embodiment has many features in common with the embodiment of FIG. 1 and the similarities will not be described in detail, although corresponding parts may be designated by corresponding reference numerals prefixed by the digit 1.

Figure 3:
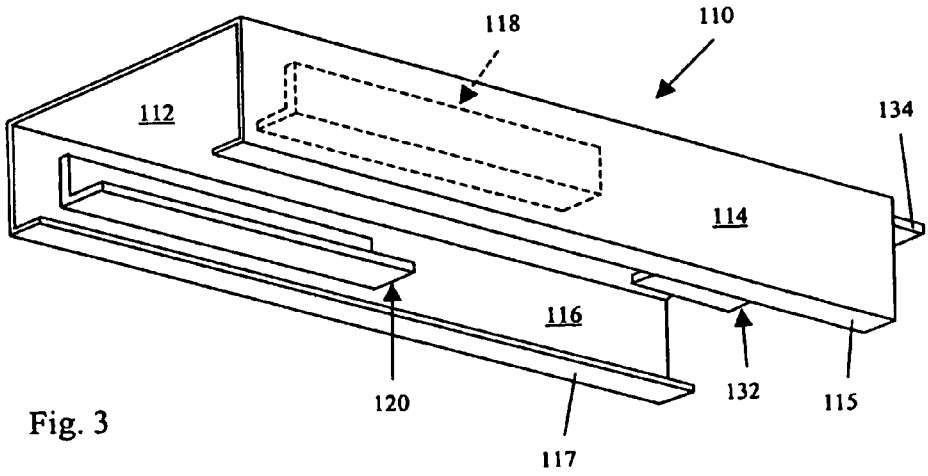
FIG. 3 is a perspective view from below of a first element of the beam of FIG. 2.
Figure 4:
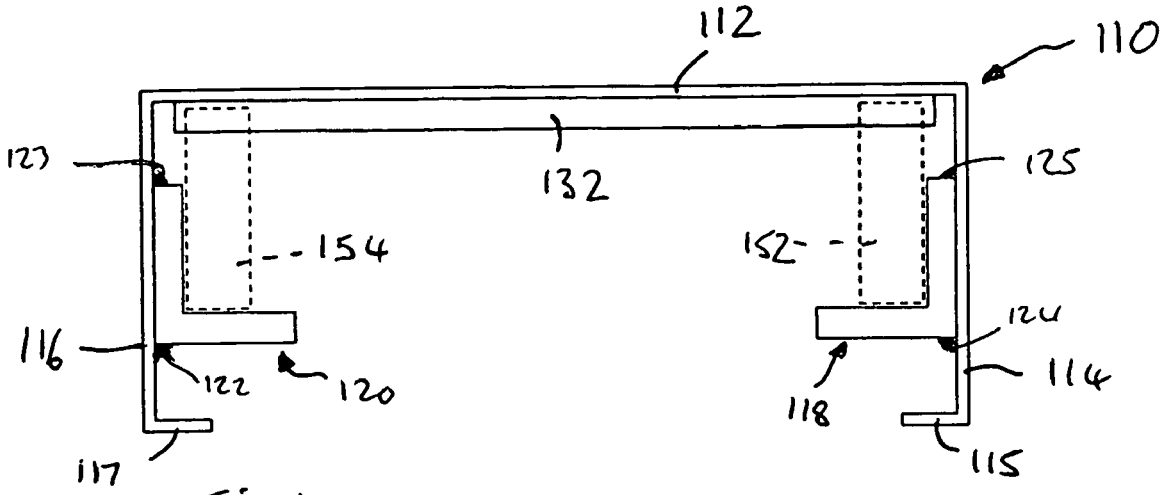
FIG. 4 is a lateral cross-sectional view of the element of FIG. 3, with the position of other parts of the beam shown in broken lines.

FIGS. 3 and 4 are respectively perspective and end views of the main member 110 of FIG. 2 without the extension member 150, although the positions of first and second bars 152, 154 are depicted in broken lines in FIG. 4 by way of illustration.

Figure 5:
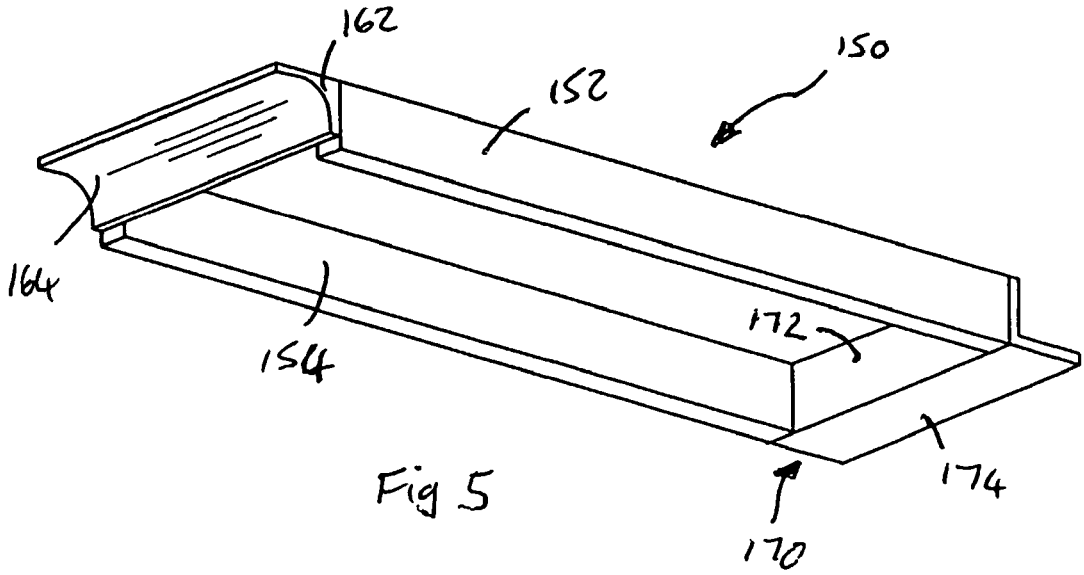
FIG. 5 is a perspective view from below of a second element of the beam of FIG. 2.
Figure 6:
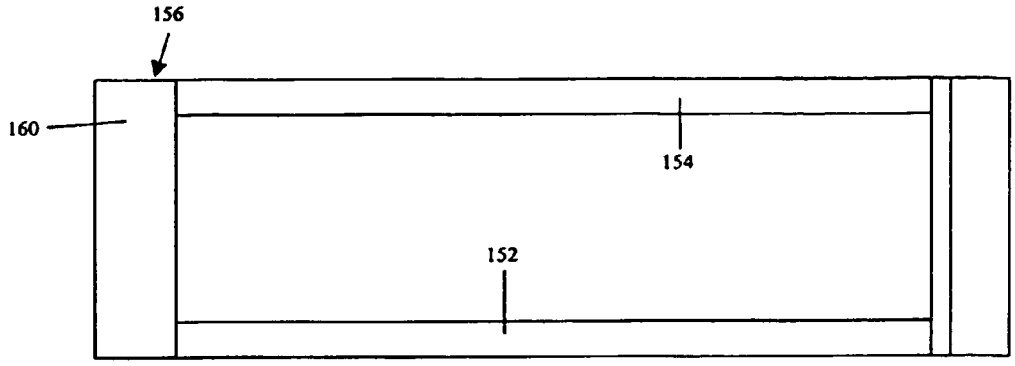
FIGS. 6 and 7 are respectively top plan and side views of the element of FIG. 5.
Figure 7:
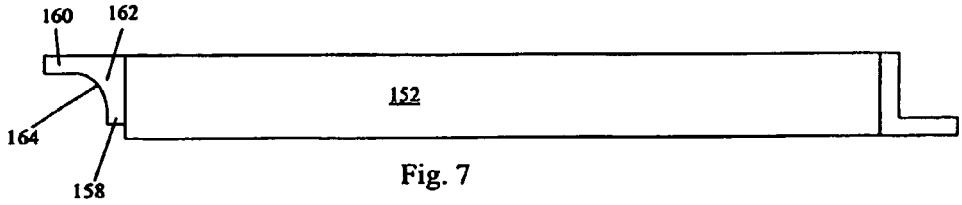

FIGS. 5, 6 and 7 are, respectively, perspective, top plan and side views of the extension member 150 of FIG. 2, without the main member 110.

With reference to FIGS. 2 to 7, a lintel, generally designated 101, differs from the lintel of FIG. 1, slightly, in dimensions (which of course may be selected as desired according to the size of the opening to be spanned and the amount of support to be provided to materials above the opening). Other differences between the lintel 1 of FIG. 1 and the lintel 101 of FIGS. 2 to 7 are as follows.

In the lintel 101, the lateral front piece 156 includes a fillet portion 162, provided at the internal corner between the limbs 158, 160 to provide an arcuate inclined surface 164 extending between the limbs 158, 160. The fillet portion 162, in use, interacts with an upper external (preferably right-angle) corner of a construction element (such as a brick—not shown, but see FIG. 8*c*) upon which the horizontally extending second limb 160 is to be supported, in order to space apart the vertically extending first limb 158 from a vertical surface of the construction element. This helps ensure that a gap is provided between the second limb 158 and the vertical surface of the construction element, allowing a lever or wedge to be introduced between the construction element and the lintel 101 in order to facilitate extraction of the second limb 160 from the construction, and allow retraction of the extension member 150. This is advantageous over prior art lintels in which an extension part is provided, in use, flush against the construction, and which require vigorous hammering (and accompanying hazardous industrial noise) to retract the extension portion.

For illustrative purposes, the fillet portion 162 is shown in exaggerated form in FIGS. 2, 5 and 7. It will further be appreciated that although the illustrated embodiment shows a concave arcuate surface 164 of the fillet portion 162, the fillet portion serves, in use, to space a forward facing surface of the extension member from a construction element, and that such spacing may be provided by spacing portions configured in any of a number of alternative shapes. For example, the spacing portion could comprise a strip of metal, or other spacing material, forming the hypotenuse of a right-angled triangle cross-section with the first and second limbs, and with the right-angle fitting into or corresponding to the internal right-angle between the limbs 158, 160 of the lateral front piece 156. Alternatively, the spacing portion could comprise a strip of material, with a beveled bottom edge, adapted to fit between the first limb 158 and the construction element, and extending downwardly less far than the first limb 158. As a further alternative, the fillet portion could comprise one or more web portions extending between the first and second limbs, with the plane of the web portions being perpendicular to the planes of the first and second limbs, and with the edges of the web portions being inclined relative to the first and second limbs. Alternatively, the one or more spacing portions could be provided by a step in the second limb of the lateral front piece, by one or more spacers projecting from a forward facing surface of the first limb of the lateral front piece, or by other suitable means. Further possible configurations for spacing portions will be apparent to the skilled person.

The extension member 150 further includes a lateral rear piece 170 which extends between the first and second bars 152, 154 and helps provide rigidity to the frame 150.

The lateral rear piece 170 is in the form of a laterally extending length of angle steel, with a first limb 172 extending vertically (assuming the lintel is in a horizontal orientation) and abutting the ends of the first and second bars 152, 154. A second limb 174 extends horizontally away from a lower edge of the first limb 172. In use, a force may be applied to the lateral rear piece 170 in order to retract the extension member 150. Such a force will typically be applied to the first limb 172, and the second limb provides structural support therefor.

In the illustrated embodiment, the lateral rear piece 170 abuts and is welded to the rear ends of bars 152, 154 and is perpendicular to the bars 152, 154. In alternative embodiments, such a lateral rear piece could be attached to the bars by different means, could be attached at intermediate parts of the bars, or could be at an angle other than 90 degrees to the bars and/or could, of course, be different in form to the illustrated angle steel of FIGS. 2, 5, 6 and 7. In alternative embodiments, the front and rear lateral pieces could, of course, be formed by configurations other than right-angle sections. In particular, a front lateral piece could be formed of a plate, not unlike the plates 32, 132 extending between bars 152, 154 and providing a forwardly projecting portion (extending forward of the bars 152, 154) for supporting the lintel.

FIG. 4 is an end view of a main member 110 with the extension member 150 omitted, but with first and second bars 152, 154 shown by broken lines. Weld beads 122, 123, 124, 125 are shown, which extend the length of the track members 118, 120 to couple the first and second track members 118, 120 to the side panels 114, 116.

A significant benefit of the illustrated embodiment over some prior art lintels which consist of inner and outer C-section elements, is the relatively small contact area between the two elements of the illustrated lintel. The small contact area reduces friction and facilitates relative movement of the elements. As can be seen in FIG. 4, the only potential areas of contact between the main and extension members are the bottom (and possibly top) edges of the bars 152, 154 and part of the laterally outer side surfaces of the bars 152, 154. By way of illustration, and considering the dimensions provided above for FIG. 1, the bottom and top edges of the bars 152, 154 are each 10 mm wide and the contact of the lateral outer sides of the bars against the track members 118, 120 is limited to 20 mm (height) of each, since this is the internal length of the vertical limb of each track member. This gives a contact area of 80 $mm^2$ per linear millimeter of contact. By comparison, in a prior art lintel, each element has a C-section form with a top panel approximately 120 mm wide, two side panels approximately 100 mm high, and two turned in portions approximately 25 mm wide, giving a contact area of about 370 $mm^2$ per linear millimeter of contact. It will be appreciated that this analysis is given by way of illustration and comparison only. In a practical embodiment there is a small spacing between, for example, the lateral outer sides of the bars and the track members 118, 120, so that undue friction or binding between these parts is avoided; for example, providing a distance between the internal faces of the track members approximately 2 mm wider than the distance between the lateral outer sides of the bars avoids undue friction while keeping the bars and the track members (and the side panels) substantially parallel, and the main and extension members aligned. Furthermore the bars might not be perfectly rectangular in cross section; in many commercially available rectangular cross section steel bars the shorter sides of the rectangle are slightly convex, and use of such bars would further reduce the contact between the members, as the bars would slide on the central parts of their convex short sides.

It will be appreciated that the vertical limbs of the track members space the bars from the side panels, and that only the lower part of the outside face of each bar makes contact with any part of the first element. The track members are provided spaced apart from the turned-in portions, to allow the side panels to have greater vertical height than the bars 152, 154. This helps provide adequate load bearing strength to the side panels 114, 116 despite their having substantially smaller thickness than the bars 152, 154.

In the embodiment as illustrated in FIGS. 2 to 7, the extension member 150 may slide into and out of the main member 110, although it is prevented from sliding all the way through the main member 110 by the plate 132 which obstructs passage of the lateral rear piece 170 and bars 152, 154 (see, for example, FIG. 4). In practice, it is preferable to have the extension member constrained so that its range of axial movement is restricted and so that it cannot inadvertently be slid all the way out of the main member.

Figure 8:
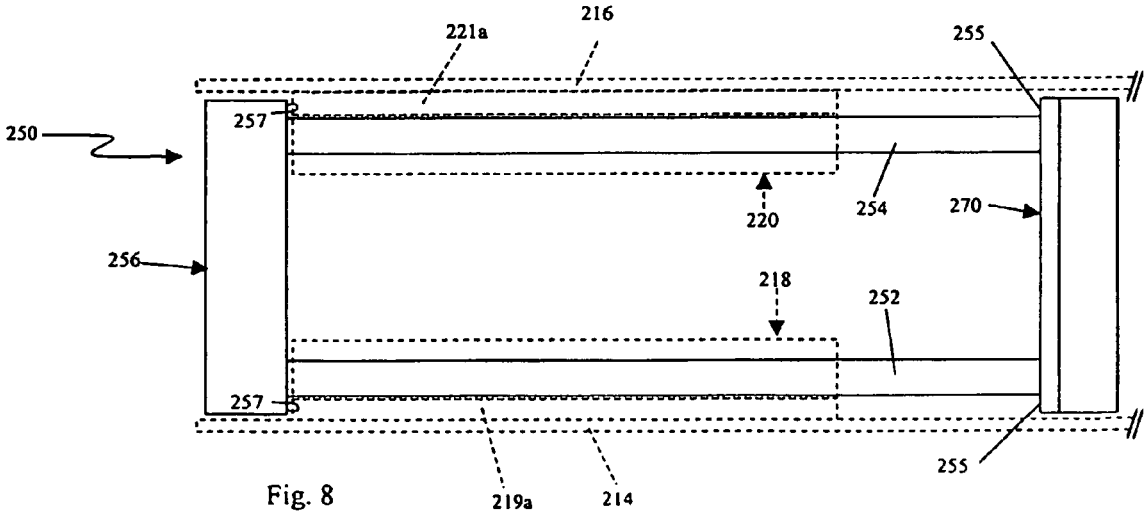
FIG. 8 is a top plan view of a variation of the element of FIGS. 5 to 7, with part of another element of a beam shown in broken lines.

FIG. 8 illustrates, in top plan view, a variation which may be preferred if it is desired to restrict movement of an extension member 250 relative to a main member 210 (shown only partially, in broken lines). Reference numerals corresponding to those used in FIGS. 1 to 7 but using the prefix digit "2" are used to designate corresponding parts. In this variation, slightly laterally extended lateral front and rear pieces 256, 270 are provided, so that they extend laterally beyond bars 252, 254. Because, in use, the outside edges of the bars 252, 254 are only fractionally laterally inward of vertical limbs 219*a*, 221*a*, of track members 218, 220 and the lateral front and rear pieces 256, 270 extend laterally outwardly past the bars 252, 254, movement of the lateral front and rear pieces past the ends of the track members 218, 220 is prevented by the track members obstructing passage of the lateral front and rear pieces 256, 270. Thus the axial movement of the extension member 250 is (in this case) equal to the difference in length between the bars 252, 254 and the track members 218, 220. In a preferred embodiment of this type, the vertical limbs 219*a*, 221*a* of the track members 218, 220 space apart the bars 252, 254 from the side panels 216, 218 by about 5 mm, and the lateral front and rear pieces 256, 270 extend laterally past the bars, on either lateral side by approximately 3 mm to form abutment portions 255, 257. Thus, the lateral front and rear pieces can effectively abut the track members 218, 220 but remain at all times spaced away from the side panels 214, 216, in order to avoid undesired contact. Of course, other additional or alternative abutment portions could be attached to the extension member and/or the main member in order to restrict relative movement therebetween. For example, studs or lugs protruding downwards from the top panel (not shown) could be positioned to interfere with the lateral front and rear pieces, or with (for example) abutment members extending laterally inwardly from the bars.

As can be seen in FIG. 8 (and as is also apparent from FIGS. 2 and 3), in a preferred embodiment the foremost ends of the track members 218, 220 are not laterally aligned with the foremost end of the main member but are set back a distance slightly so that the front lateral piece 256, and indeed the entire extension member, can be fully axially retracted into the main member 216. This is desirable since it allows the lintel to be deployed and removed from situations where the width to be spanned is only slightly greater than the axial length of the main member.

Alternative embodiments could be provided with variations from the characteristics described above, and many such variations will be evident to the skilled person. For example, in some embodiments the turned-in portions of the main member may not be considered essential, and the main member may therefore include a portion the cross-section of which is three sides of a rectangle. However, the turned-in portions are provided in most commercially available steel C-sections and provide a beneficial stiffening effect upon the side panels. In a further embodiment, the track members are lengths of angle steel abutting the turned-in sections (i.e. they are positioned lower from the side panels than in the illustrated embodiments). This structure is not preferred, since in preferred embodiments the height of the bars is preferably less than the height of the side panels. It will be appreciated that in preferred embodiments, the height of the side panels contributes to the stiffness and strength of the main member, and since the material thickness of the side panels is substantially less than the thickness of the bars, it is desirable that the height of the side panels be greater. Providing bars of greater height than is required adds unnecessary undesirable weight, although it would be possible to reduce the thickness of the bars to counteract their increased height, while retaining adequate strength. In order to provide a good fit between the main and extension members, it is desirable that the bars should be able to contact the main member at both the tops and bottoms thereof (and in the preferred embodiments they contact the track members at the bottoms thereof and the top panel at the tops thereof). An embodiment in which the top edges of the bars are substantially below the level of the top panel is possible (and could include track members on the side panels, below the level of the top panel, for guiding the top of the bars) but is not preferred because of consequent difficulties in aligning the upper surfaces of the main and extension members to provide straight and aligned construction above the lintel.

In an embodiment where the bottoms of the bars are at a similar level to the turned-in portions, the turned-in portions may be used to support the bars, that is, additional track members might not be required. Typical, commercially available C-section steel is not made sufficiently accurately to allow the desired tightness of fit for good alignment, but also the desired freedom of movement, for bars which slidingly contact both the turned-in portion and the top panel, but suitable C-section could be manufactured and/or obtained. In this case, it is desirable to employ some spacing structure which avoids contact of the entire height of the sides of the bars, with the side panels. Suitable guides, fillets or spacers will be evident to the skilled person, for example, one or more axially extending strips of material (e.g. steel) attached to the outside of each bar, or to the inside of each side panel or a combination of these options, could be used.

It will be appreciate that the described embodiment differs from prior art extensible lintels in that the extension member does not have a planar upper surface extending its entire width and length. This results in reduced weight and contact area with the main element, but has been found to allow materials to be adequately supported. In one alternative embodiment the axial part of the extension element which can extend from the main element is provided with a web (for example of thin sheet steel, or steel mesh) which extends between the bars. This helps prevent a user placing fingers around the front lateral piece or through the open space defined by the frame-like extension member, and thus helps prevent accidental trapping of such fingers between the front edge of the top panel and the rear of the lateral front piece, when the extension member is retracted. It is desirable for such a lateral web to be positioned so that it cannot contact the main member in use, for example, it is preferably set a few millimeters below the upper edges of the bars. Such web is desirable from a safety perspective, but its purpose would not be to contribute substantially to the structural strength of the extension member. In a further alternative embodiment, the two track members could be replaced by a single member, most likely a generally U-shaped steel section with arms that are relatively short in height compared to its width. Such a member could provide a support portion for each of the bars, but is not preferred because the laterally wide U-shaped section would provide unnecessary additional weight.

FIGS. 9*a* to 9*e* illustrate schematically the use of a preferred embodiment of an extensible beam, in the form of a lintel, in accordance with the present invention to provide support, during construction, for construction materials above an opening in a wall.

Figure 9A:
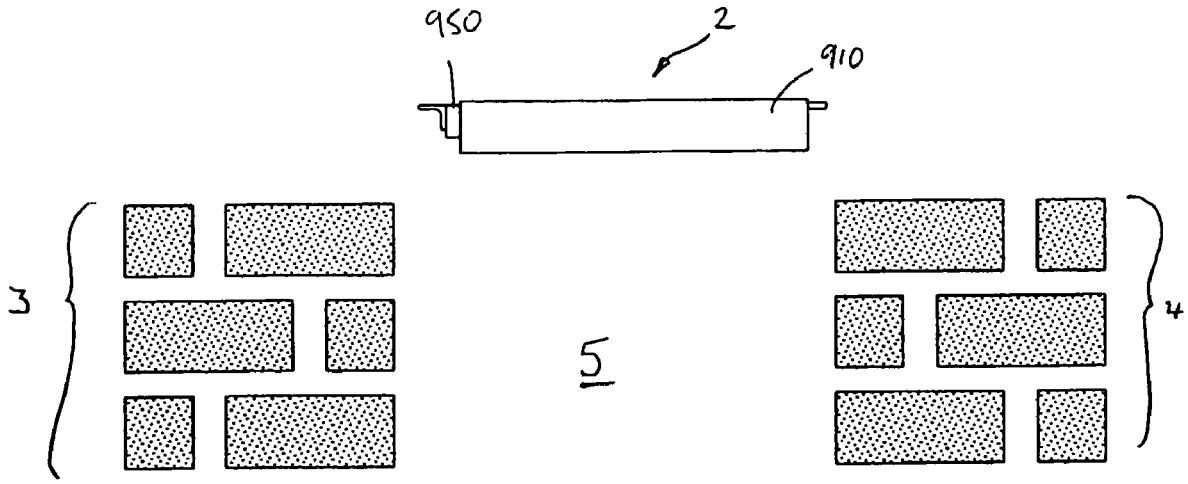
FIGS. 9*a* to 9*f* are schematic representations illustrating the use of a beam of the type illustrated in FIG. 2 in constructing a wall including an opening.

FIG. 9*a* shows a lintel, generally designated 2, in the vicinity of wall portions 3, 4 which define the sides of an opening 5 above which construction materials are to be placed in order to form a window opening. As seen in FIG. 9*a*, the lintel 2 is close to an opening to be spanned, and includes a first, main, element 910 and a second, extension, element 950 which is able to slide into and out of the first element 910 in order to vary the length of the lintel. (Although the second element 950 is, for clarity, shown protruding from the first element, it will be appreciated that in a preferred embodiment, the second element may be fully retracted prior to extension of the lintel.) The wall portions 3, 4 are shown schematically as being formed of a number of construction elements in the form of bricks, which are for clarity shown shaded and spaced apart as they would be, in practice by mortar (not shown) or a like construction material. It will be appreciated that FIGS. 9*a* to 9*f* are schematic and should not be regarded as being to scale, in particular the spacing between the bricks, and between the bricks and the lintel, is exaggerated.

Figure 9B:
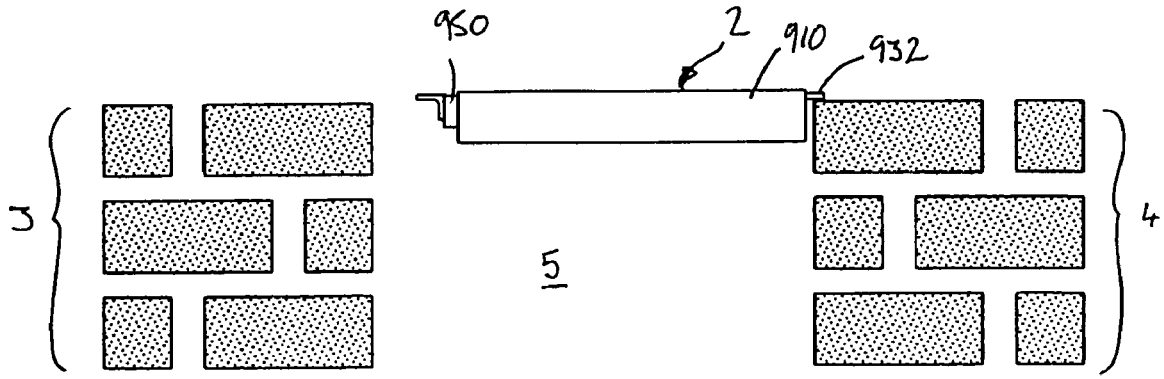

FIG. 9*b* shows the lintel 2 supported on a brick which forms part of the second wall portion 4. More specifically, the first element 910 is provided with a wall engaging portion 932 (such as, for example, a plate such as the plates 32, 132 described above). As shown in FIG. 9*b*, the second element 950 is in a substantially retracted position and the lintel 2 does not span the opening 5.

Figure 9C:
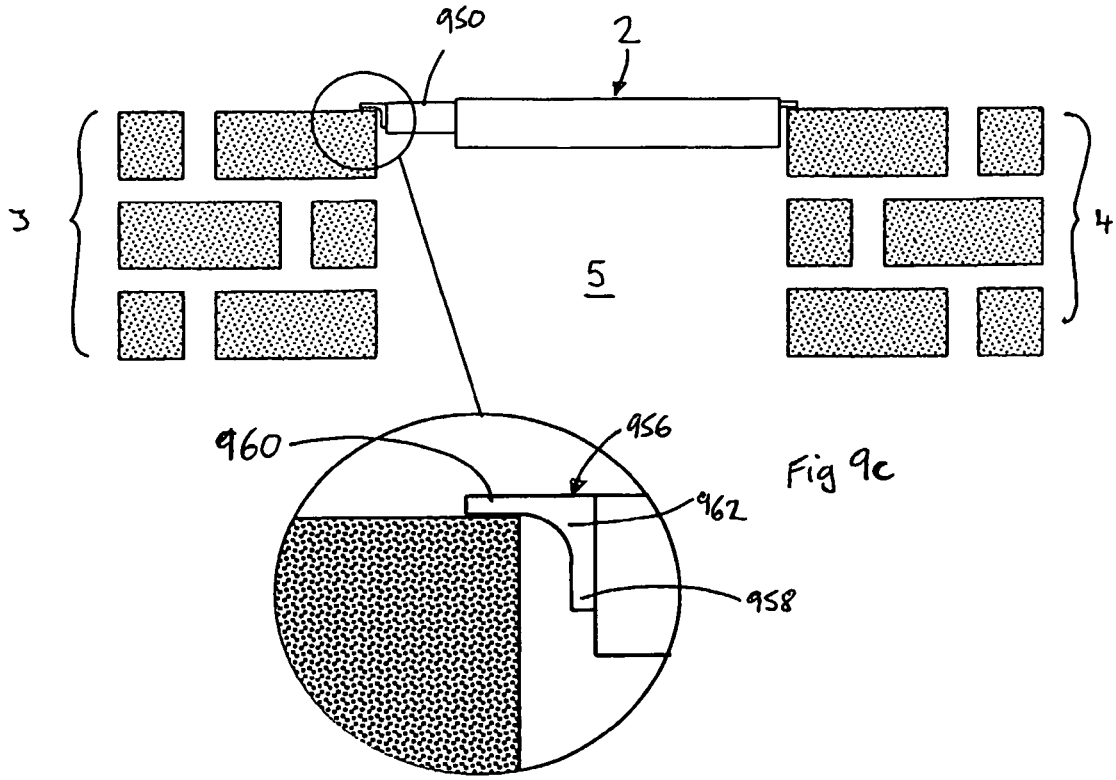

The next stage, in use, is extension of the second element 950 to the position illustrated in FIG. 9*c*, so that the lintel 2 spans the opening 5, and engagement portion 960 of the second element 950 supports the second element 950 on a brick of the wall portion 3.

As shown in the inset of FIG. 9*c*, the support element 960 may be part of a lateral front piece 956 including a fillet portion 962 which serves to space apart the brick from a foremost vertically extending part of the second element (which the described embodiment is a downwardly extending limb 958 of the laterally extending front piece 956). In the configuration and position shown in FIG. 9*c*, the lintel 2 effectively spans the opening 5, and is capable of bearing a load, such as the weight of construction materials to be placed above the opening 5.

Figure 9D:
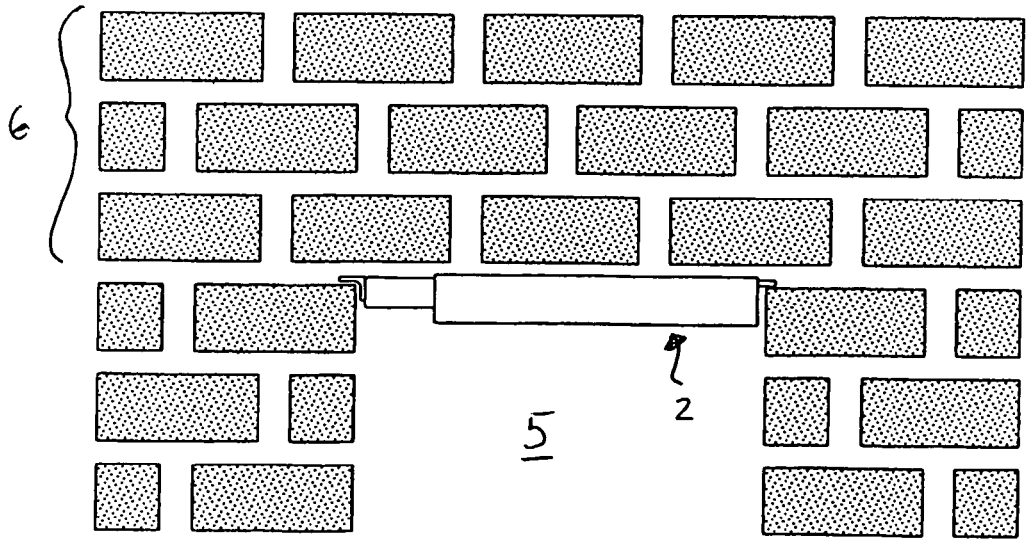
Figure 9E:
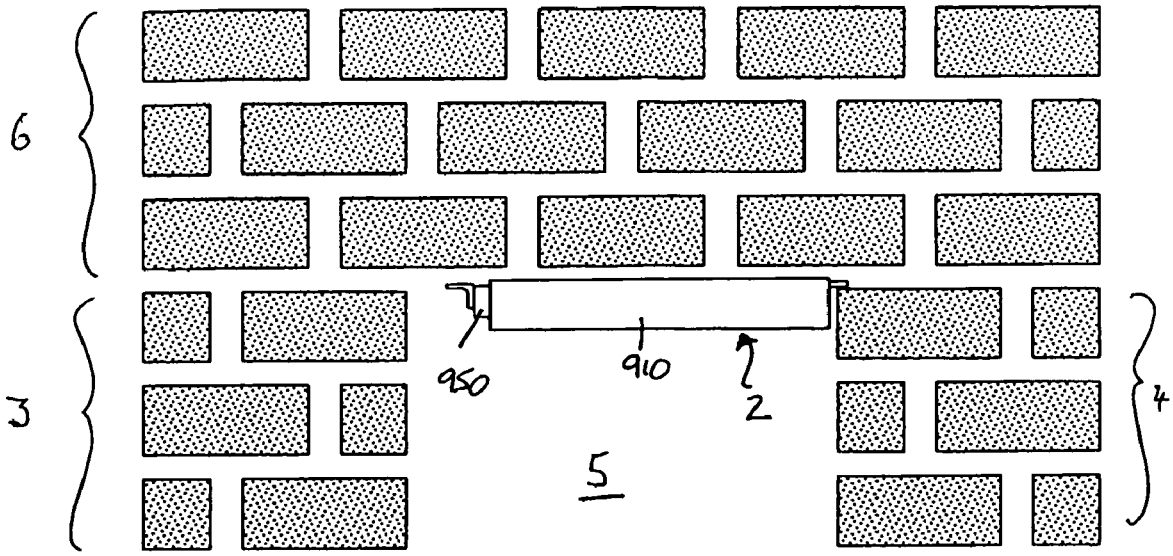
Figure 9F:
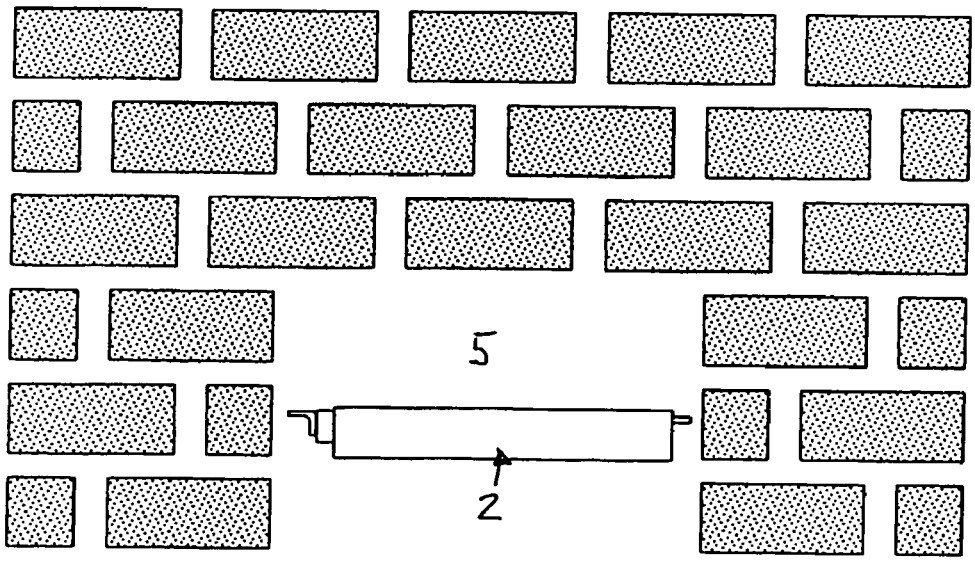

FIG. 9*d* shows construction materials 6 placed above the opening 5 and the lintel 2. Once the construction materials 6 are in place and cured sufficiently to safely support their own weight, the lintel 2 may be removed. The first step in the removal process, as shown in FIG. 9*e*, is retraction of the second element 950 at least partially into the first element 910. The retraction stage may be problematic with some prior art lintels and may rely upon forceful hammering of one or more parts of such lintels, which may involve a risk of injury and produce noise levels sufficient to risk hearing damage. However, at least preferred embodiments of the present invention avoid or mitigate these problems by ensuring, as described above, that a gap is provided between a foremost vertically extending part of the second element, and a construction element upon which the lintel is supported. This allows insertion of a lever, or other forcing device, to enable forcing of the second element away from the construction element. Retraction is further facilitated by providing a small contact area between the first and second elements facilitating retraction of the second element. Furthermore, it has been found that providing an engaging portion with an axial length (in the direction of the length of the beam or lintel) of approximately 3 cm provides adequate support for most common applications, while allowing retraction.

Once the second element 950 is disengaged from the wall 3, 4, 6, the lintel 2 as a whole may be removed, leaving the opening 5 closed at the top thereof.

It will be appreciated that preferred embodiments provide extensible beams, or lintels, which work effectively and are economical and easy to produce by cutting, positioning and welding of staple commercially available materials. For example, in the embodiments of FIGS. 1 to 9, the main member can be made from a length of C-section steel, two lengths of angle steel, and a flat steel plate. The extension member can be formed from two lengths of rectangular steel bar, and two lengths of angle steel.

In the claim which follows and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It is to be understood that, if any prior art publication is referred to herein, such reference does not constitute an admission that the publication forms a part of the common general knowledge in the art, in Australia or in any other country.

Modifications and improvements may be incorporated without departing from the scope of the present invention.

What is claimed is:

1. An extensible beam comprising:

a first, elongate, element defining a channel therein, the first elongate element comprising: an upper portion which provides an upwardly facing surface to support materials above the beam, and first and second lateral portions which project generally perpendicular from respective opposing sides of the upper portion so that the upper portion and lateral portions define the channel; and respective first and second support portions which project inwardly from the respective first and second lateral portions; and a second element adapted to move, in the channel, relative to the first elongate element in order to vary the amount of overlap between the first and second elements and thereby vary the length of the beam;

wherein the second element is in the form of a frame comprising: first and second generally parallel spaced apart elongate bars which form lateral sides of the frame and which slidingly engage the first and second support portions, respectively; a first cross member which extends between, and spaces apart respective first ends of the first and second bars, and forms a first transverse member of the frame; and a second cross member, spaced apart from the first cross member in the direction of elongation of the bars, which extends between, and spaces apart, the first and second bars and forms a second transverse member of the frame and wherein the first and second bars are separately formed pieces.

2. An extensible beam as claimed in claim 1, wherein the first element comprises a length of metal C-section.

3. An extensible beam as claimed in claim 1, wherein the first and second bars have substantially greater thickness than the lateral portions of the first element.

4. An extensible beam as claimed in claim 1, wherein the bars are solid bars.

5. An extensible beam as claimed in claim 1, wherein in use, with the beam in a horizontal orientation, the vertical height of each bar is approximately four times its thickness.

6. An extensible beam as claimed in claim 1, wherein in use, with the beam in a horizontal orientation, the height of each bar is smaller than the height of the lateral portions of the first element.

7. An extensible beam as claimed in claim 6, wherein the height of each bar is less than 80% of the height of the lateral portions of the first element.

8. An extensible beam as claimed in claim 1, wherein the second cross member extends between respective second ends of the first and second bars.

9. An extensible beam as claimed in claim 1, wherein the second element is located at least partially inside the channel of the first element and is adapted, in use, to be moved further into the first element in order to reduce the length of the beam, and to be moved further out of the first element in order to increase the length of the beam, and wherein in the extended configuration less than half of the second element can extend out of the first element.

10. An extensible beam as claimed in claim 1, wherein the second element further comprises a web portion extending between the first and second bars, the web portion being adapted to prevent parts of a user from being caught within the beam during use.

11. An extensible beam as claimed in claim 1, wherein the first and second support portions are welded to, and supported by, the respective first and second lateral portions.

12. An extensible beam as claimed in claim 9, wherein in use, the relative positions of the first and second elements are constrained so that substantially the entire length of each support portion is in contact with, or closely adjacent to, a part of the corresponding bar, irrespective of whether the second element is retracted or extended relative to the first element.

13. An extensible beam as claimed in claim 1 wherein a first abutment portion of the second element is adapted to engage part of the first element to restrict axial movement of the second element away from the first element, such that not more than 50% of the length of the second element can extend out of the first element.

14. An extensible beam as claimed in claim 1, wherein in use, the bars are spaced apart from the lateral portions by one or more parts of members which form the support portions.

15. An extensible beam as claimed in claim 9, wherein the second element is dimensioned so that a degree of lateral movement within the first element is possible.

16. An extensible beam as claimed in claim 1, wherein one, or both, of the first and second elements is made substantially from aluminium.

17. An extensible beam as claimed in claim 1, wherein the extensible beam is a reusable extensible lintel.

18. An extensible beam as claimed in claim 17, wherein the second cross member is adapted to receive a force in order to assist retraction of the second element into the first elongate element.

19. An extensible beam as claimed in claim 1, wherein the first elongate element includes a first engaging portion, at an end thereof for engaging a structure defining a first side of an opening and providing support for the beam relative to the structure, wherein the second element includes a second engaging portion for engaging a structure defining a second side of an opening and providing support for the beam relative to the structure so that the beam can be supported across the opening, and wherein the engaging portions comprise respective horizontally orientated axially extending portions the upper surfaces of which are substantially coplanar with the upwardly facing surface of the first elongate element.

20. An extensible beam as claimed in claim 1, wherein the first and second support portions are provided by opposite side portions of a member which extends between the first and second lateral portions of the first elongate element.

* * * * *